US005589660A

United States Patent [19]

Perry et al.

[11] Patent Number: 5,589,660

[45] Date of Patent: Dec. 31, 1996

[54] ENHANCED PERFORMANCE BLASTING AGENT

[75] Inventors: Robert W. Perry, Morgan Hill; Forrest R. Goodson, San Jose, both of Calif.

[73] Assignee: United Technologies Corportion, Hartford, Conn.

[21] Appl. No.: 510,751

[22] Filed: Aug. 3, 1995

[51] Int. Cl.[6] ..... C06B 45/06

[52] U.S. Cl. ..... 149/18; 149/41; 149/60

[58] Field of Search ..... 149/18, 41, 60

[56] References Cited

U.S. PATENT DOCUMENTS

| | | | |
|---|---|---|---|
| 1,891,500 | 12/1932 | Burrows | 149/41 |
| 3,507,719 | 4/1970 | Hodgson | 149/18 |
| 4,058,420 | 11/1977 | Barnhard IV et al. | 149/41 |
| 4,081,299 | 3/1978 | Griffith | 149/41 |
| 4,110,134 | 8/1978 | Wade | 149/41 |
| 4,386,977 | 6/1983 | Ikeda et al. | 149/21 |
| 4,453,989 | 6/1984 | Mullay | 149/41 |
| 4,456,492 | 6/1984 | Alexander et al. | 149/41 |
| 4,470,855 | 9/1984 | Bampfield | 149/41 |
| 4,525,225 | 6/1985 | Cechanski | 149/46 |
| 4,548,659 | 10/1985 | Jessop | 149/18 |
| 4,585,495 | 4/1986 | Honeyman et al. | 149/41 |
| 4,600,450 | 7/1986 | Jessop et al. | 149/18 |
| 4,600,451 | 7/1986 | Jessop et al. | 149/41 |
| 4,600,452 | 7/1986 | Jessop et al. | 149/18 |
| 4,705,582 | 11/1987 | Aubert | 149/39 |
| 4,747,892 | 5/1988 | Spencer | 149/18 |
| 5,261,327 | 11/1993 | Carney | 102/312 |

*Primary Examiner*—Edward A. Miller

*Attorney, Agent, or Firm*—McAulay Fisher Nissen Goldberg & Kiel

[57] ABSTRACT

An improved blasting composition comprising from about 13 to 15 weight percent unrefined petroleum wax, from about 15 to 20 weight percent aluminum powder, from about 10 to 52 weight percent sodium perchlorate and from about 10 to 52 weight percent ammonium nitrate. The blasting composition may be used in combination with ANFO and in place of conventional solid AP propellants and represents an economical alternative thereto.

7 Claims, 5 Drawing Sheets

ENHANCED PERFORMANCE BLASTING AGENT

BACKGROUND OF THE INVENTION

Quarry blasting for rock, such as limestone, granite, and other igneous rocks conventionally uses ANFO as the explosive. ANFO is a mixture of approximately 94% ammonium nitrate and 6% fuel oil.

In quarry blasting, a plurality of boreholes are drilled in a predetermined pattern or array. For example, the holes are drilled in a 10 foot by 10 foot pattern, with 3–9 inch diameters and depths of 20–90 feet. A cast booster with a blasting cap is placed in the bottom of the hole, and ANFO is added into the hole up to level approximately eight feet from the surface. Small rock chips from ¼–½ inch in size, commonly called stemming, is placed in the top of the hole to confine the ANFO. The boreholes are detonated sequentially so as to provide free faces toward which the broken rock moves.

The energy and power factors vary, depending upon the geological structures being blasted. For example, limestone requires a power factor of 2–5 pounds per ton.

ANFO is also used in open pit mining, for such minerals as coal, taconite, copper and gold. In open pit mines, the boreholes are typically 10–15 inches in diameter, drilled in a 28×28 feet pattern to produce 40–60 feet faces.

ANFO is a popular explosive in both quarry mining and open pit mining due to its low cost. However, ANFO has several limitations. When the boreholes are filled with solid columns of ANFO, only 60–70% efficiency is achieved as the detonation rises in the borehole. Accordingly, in such a straight ANFO shot, the 30–40% waste must be considered to avoid oversize material which is detrimental to the digging and crushing equipment used after the blast to process the shot rock. Also, such waste increases the cost of producing the shot rock.

Methods for overcoming the inefficiencies of solid ANFO shot and to enhance its action in the borehole have been developed. One such method is the use of solid AP propellant which has typically been used as a rocket fuel. Because of various nuclear disarmament treaties and the requirements that missiles be disarmed, this material has essentially become an excess material. It must be disposed of and traditionally has been disposed of as a waste by open air firing of the propellant motors or open burning of the propellant. However, these disposal methods are no longer viable because of environmental considerations.

U.S. Pat. No. 5,261,327 proposes the use of such solid AP propellant with ANFO as a blasting composition for quarry blasting. As disclosed therein, the solid AP propellant is a mixture of about 70% ammonium perchlorate, 20% aluminum and 10% binder.

However, the use of such solid propellant has become problematic because, firstly, the amount of the solid propellant remaining has diminished significantly. In addition, it is relatively expensive. Thus, even if one were to formulate additional solid propellant, its cost lends against its desirability for use in quarry blasting.

SUMMARY OF THE INVENTION

We have discovered a new and improved blasting composition and a method for surface mine blasting. In particular, the present invention provides a composition which provides results as good as or better than the conventional combination of ANFO with AP propellant and it is substantially less expensive.

Specifically, the present composition comprises from about 13 to 15 weight percent unrefined petroleum wax, from about 15 to 25 weight percent aluminum powder, from about 10 to 52 weight percent sodium perchlorate and from about 10 to 52 weight percent ammonium nitrate. As used herein, all weights and percent by weight are based on the total weight of the composition.

The inventive blasting composition is used in combination with ANFO in essentially a conventional manner, for example, as described in U.S. Pat. No. 5,261,327 in place of the solid AP propellant as described in this patent.

Also disclosed is a blasting system comprising ANFO as a first component and the inventive composition as a second component. The relative amounts of first to second components is from about 70:30 to 30:70 and, preferably, from about 40±2:60±2 to 60±2:40±2.

DETAILED DESCRIPTION OF THE INVENTION

Figure 1:
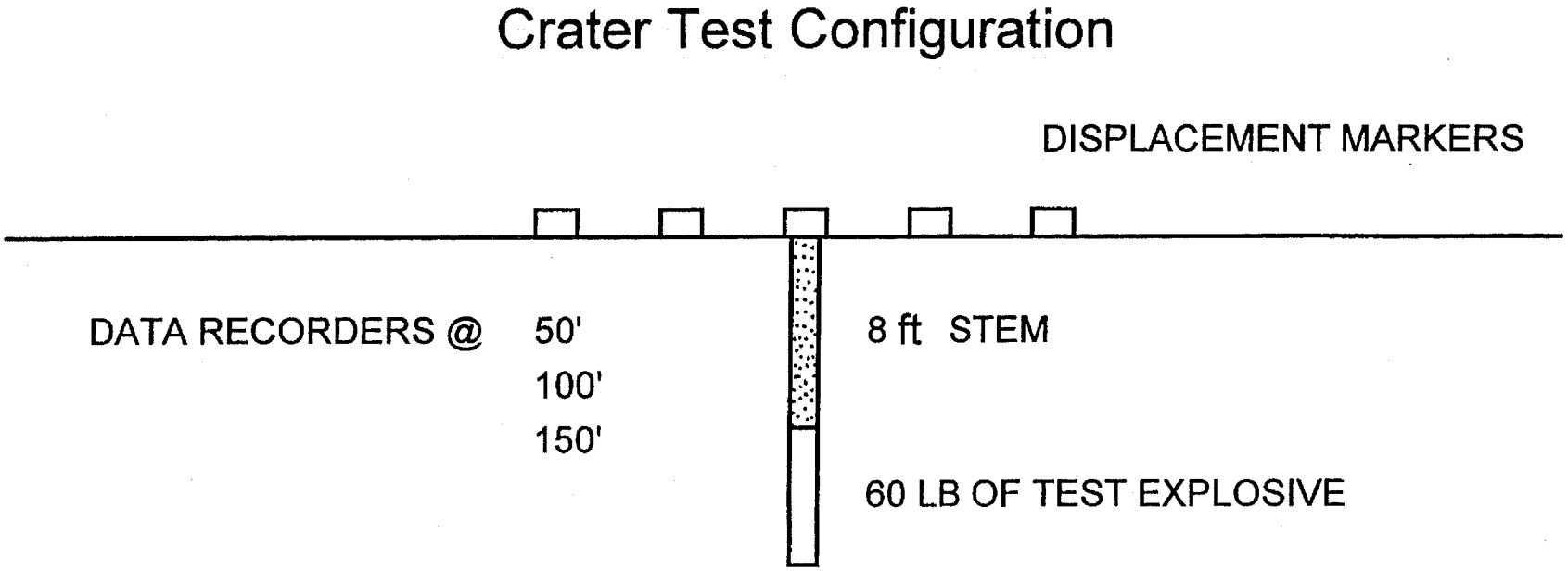
FIGS. 1 and 5 show test configuration and FIGS. 2 through 4 and 6 are graphical depictions of the results of the tests performed.

The propellant of the present invention is preferably a hot melt type composition comprising petroleum wax, atomized aluminum powder, sodium perchlorate and aluminum nitrate. The wax operates as a binder which consolidates the propellant. The aluminum powder increases the thermochemical heat release during explosion, the sodium perchlorate and ammonium nitrate act as oxidizers.

The composition may be prepared by first melting the petroleum wax, generally at a temperature of from about 140° to 150° F. The aluminum powder is admixed into the melted wax with stirring. The sodium perchlorate is then added with stirring. Finally, the ammonium nitrate is added into the mixture with stirring. All of these operations may be carried out at atmospheric pressure.

After mixing, the propellant may be cooled on a continuous belt, granulated, and packaged, or poured into appropriate molds, e.g., plastic bags and the like and allowed to cool and harden.

In use, for example, in using the explosive composition in a quarry or open pit mine, a plurality of bore holes having predetermined diameters and depths are drilled in a predetermined pattern or array. A primary charge, such as, a cast booster is lowered into the bottom of the hole and wire leads from the primary charge extend upwardly to the top of the hole and are secured to prevent the wires from falling into the hole.

ANFO is then poured into the hole to cover the primary charge to a desired depth, e.g., for example, 12 inches. The inventive propellant packaged either in stick or crushed form is placed in the hole and an additional layer of ANFO is added on top of the propellant. The layering of the additional ANFO is then added and layering of ANFO and the inventive propellant is repeated until the bore hole is filled to approximately 10 feet from the surface. A layer of ANFO may then be added into the hole.

Generally, bore holes are wired in series and after the normal and appropriate safety precautions are taken, the blast is initiated by actuating the primary charge or charges.

Specific details of such use as noted are conventional and are described in U.S. Pat. No. 5,261,327.

A series of tests were carried out to evaluate the inventive composition as follows:

Four different compositions of the inventive propellant were prepared containing varying amounts of the ingredients. The composition was prepared by first melting the petroleum wax at 140° F. to 150° F. Aluminum powder was then added and the mixture was stirred at 20 rpm for 5 minutes at atmospheric pressure. Then, the specified amount of sodium perchlorate was added and the mixture again stirred at 20 rpm for 5 minutes at atmospheric pressure. One half of the specified amount of ammonium nitrate was added the mixture again stirred at 20 rpm for 10 minutes at atmospheric pressure. Thereafter, the remaining half of the specified amount of ammonium nitrate was stirred into the mixture at 20 rpm for 10 minutes. The mixture temperature was maintained at 140° to 150° F. The propellant was then cast into the polyethylene bags while hot and allowed to cool and harden.

The wax used was an unrefined petroleum wax designated 142N from Chevron Corporation. It exhibited a congealing point of 129° F. per ASTI-D938, a case penetration value of 71 at 77° F. per ASTI-D937, an oil content of $469_0$+$399_0$ per ASTI-D3235 and ASTI-D721, respectively, and a color of <4.5 per ASTI-D1500. The end paraffin weight of the wax determined by gas chromatography was $349_0$, and average molecular weight is 461. This is an unrefined wax having a light brown to dark color. It contains organic sulfur compounds as impurities. The specific gravity is about 0.92 g/cc at 77° F. The wax is a non-elastomeric relatively small molecule as compared, for example, to a cured organic polymer. In addition, in contrast to the conventional cured polymer which exhibits well defined viscoelastic properties, the wax merely softens and melts to a liquid. In addition, the cured polymer conventionally used for solid AP propellant as commercially available, costs anywhere from 10 to 50 times that of the wax.

The aluminum powder used was Alan-Togo America ATA 101. This is a free-flowing, atomized aluminum powder having a regular particle size with a specific gravity of about 2.7 g/cc. It is substantially pure metallic aluminum having an average particle diameter of 18 microns. This material was formerly known as Alan MD101. Its main purpose is to raise the heat of combustion, enhance fluidity and increase the density of the propellant composition.

The sodium perchlorate used was from Western Electro Chemical Company (WECCO) NaC104. It has a specific gravity of 2.54 and an approximate particle size of 300 microns. Sodium perchlorate is the most economical perchlorate commercially available today and is about one third the cost of ammonium perchlorate. Sodium perchlorate is also more dense than ammonium perchlorate, i.e., 2.54 g/cc versus 1.95 g/cc. While sodium perchlorate is hygroscopic, this hygroscopicity is counteracted to an extent by the mixing with hot wax.

The ammonium nitrate used ($NaH_4NO_3$) has a specific gravity of 1.725 g/cc, an approximate drill size of 1,000–2,000 microns. It is readily available because of its use as agricultural fertilizer. While the pure material is hygroscopic, the drilling coating process renders it free flowing. The grade used in the present test was E-2 grade manufactured by Northern California Fertilizer Company.

Five different explosive tests were carried out and crater blast evaluations made thereof. The compositions were as follows:

Composition 1 ANFO;

Composition 2 equals a 40/60 blend of composition number 722/ANFO;

Composition 3 a 40/60 blend of composition number 724/ANFO;

Composition 4 a 40/60 blend of composition number 726/ANFO;

Composition 5 a 40/60 blend of composition number 727/ANFO.

The blasting compositions used in the tests were as follows:

| | Composition Number | | | |
|---|---|---|---|---|
| Ingredient | 722 | 724 | 726 | 727 |
| Wax | 15% | 15% | 13% | 13% |
| Aluminum powder | 25% | 15% | 25% | 25% |
| Sodium perchlorate | 10% | 10% | 10% | 52% |
| Ammonium nitrate | 50% | 60% | 52% | 10% |

In commercial explosive applications, three factors are generally of primary importance to the user, namely, rock mass fragmentation, rock mass displacement and excessive ground vibration. A series of tests using the inventive composition in combination with ANFO were evaluated. Generally, a direct indication of the power of an explosive is its ability to displace the rock mass. High vibration levels can be an indication of overconfinement or inability of an explosive to displace the rock mass generally low vibration levels are desirable in all types of blasting.

A series of individual hole crater blasts were carried out in order to evaluate the inventive composition as described above. Single hole crater tests were conducted to compare the strength of the various test explosives. In each test, a control hole of ANFO was used to establish a base line for comparison. For each test, the charge, weight and depth of burial was constant.

FIG. 1 shows the crater test configuration.

Figure 2:
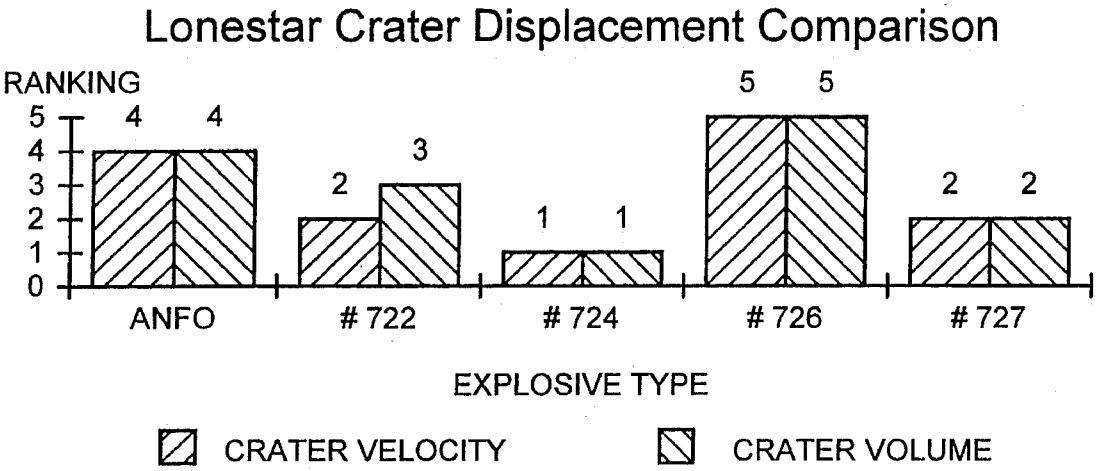

The crater displacement of each of the compositions compared to ANFO is depicted in FIG. 2.

Figure 3:
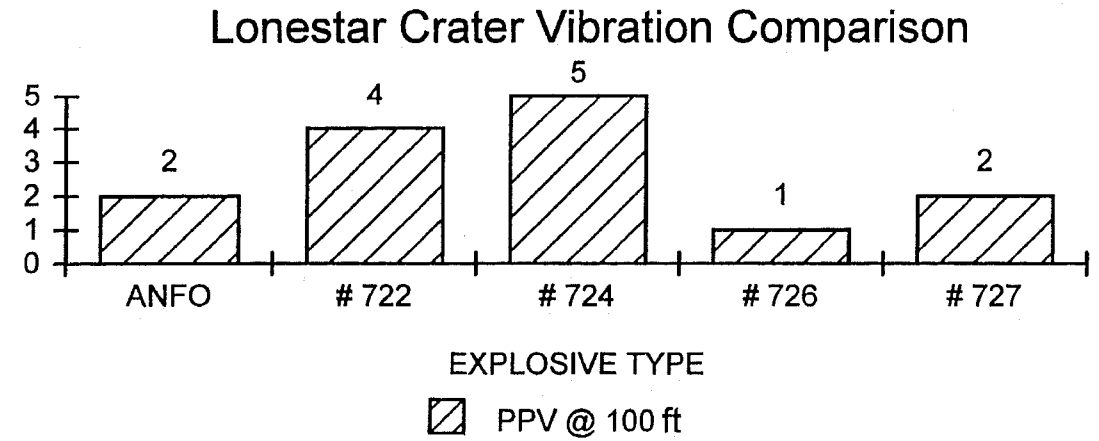

A comparison of crater vibration is shown in FIG. 3.

Figure 4:
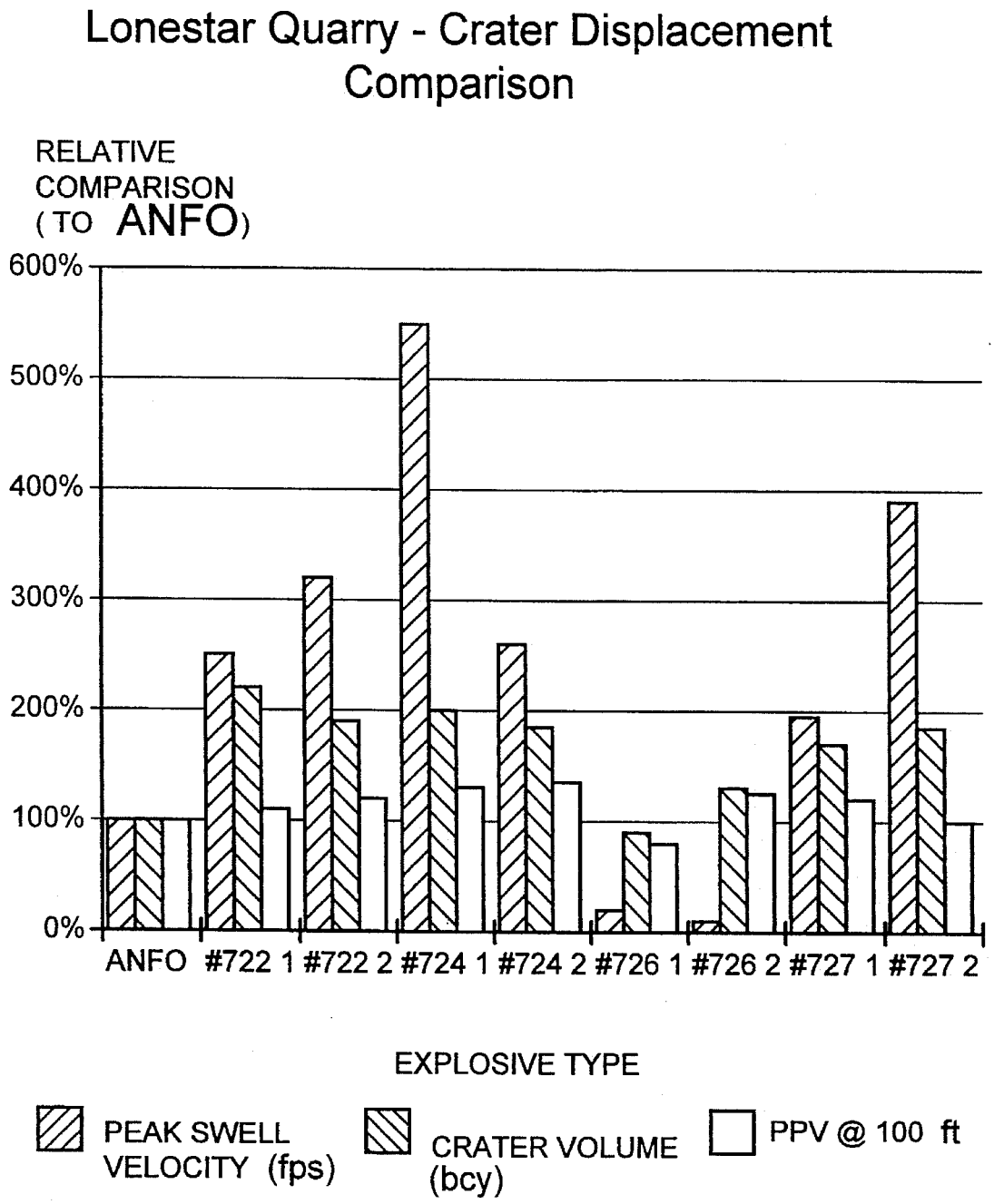

FIG. 4 depicts an overall comparison of crater displacement for two runs of each of the inventive compositions.

As can be seen from the data depicted in these figures, the inventive compositions performed equivalent to or at least as good as ANFO alone.

The displacement was determined using high speed cameras set up appropriately to provide face movement, ground swell and stemming ejection data. The cameras had a framing rate of up to 400 frames/second and produced a picture every 2.5 ms. Accurate calculations of face movement and ground swell velocity were obtained by positioning targets on the face, bench top and pit floor at specific locations. Development of the film and linkage to a computer allowed precise calculations and raw data.

Figure 5:
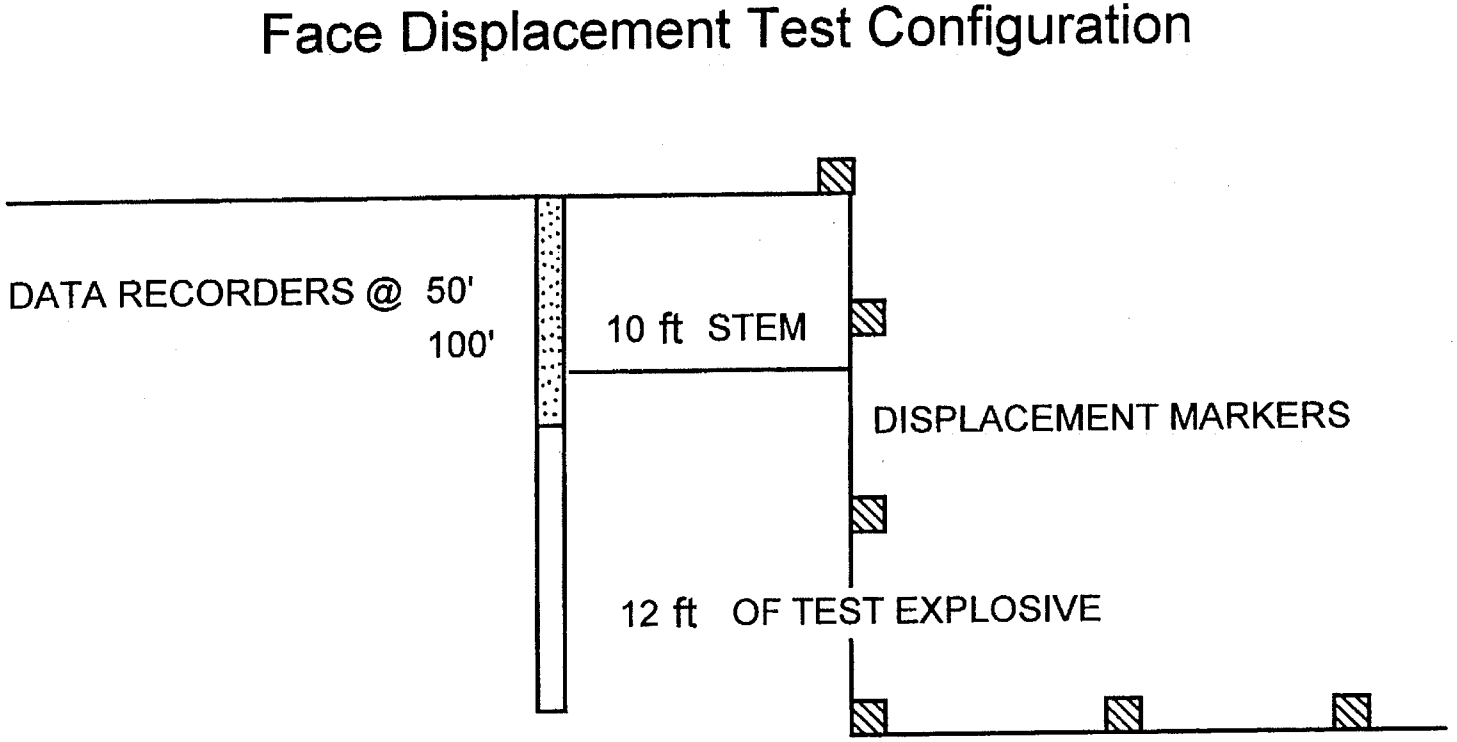

Face displacement evaluations were then carried out to evaluate the inventive composition. Generally, in most explosive applications for breaking rock, it is advantageous to blast to a free face. The free face ideally is parallel to the axis of the explosive column for optimum energy distribution. Under such conditions, the explosive functions in a different manner than it does in crater blasting. When the explosive column detonates, the energy is directed toward the free face. The face bends out from the middle of the column and breaks. Breakage occurs from high compressional stress intensities within the rock mass and as stress waves rebound off the free rock face, the rock is placed under tension and if the intensity is sufficiently high, the rock fails. Once the rock has been broken, it is pushed out by the high pressure gases from the detonation. The displacement velocity and range is directly related to the gas production characteristics of the explosive. Single hole face displacement trials were conducted to evaluate the test explosives when shooting to a free face. FIG. 5 shows a typical test configuration for face displacement evaluation as used.

Figure 6:
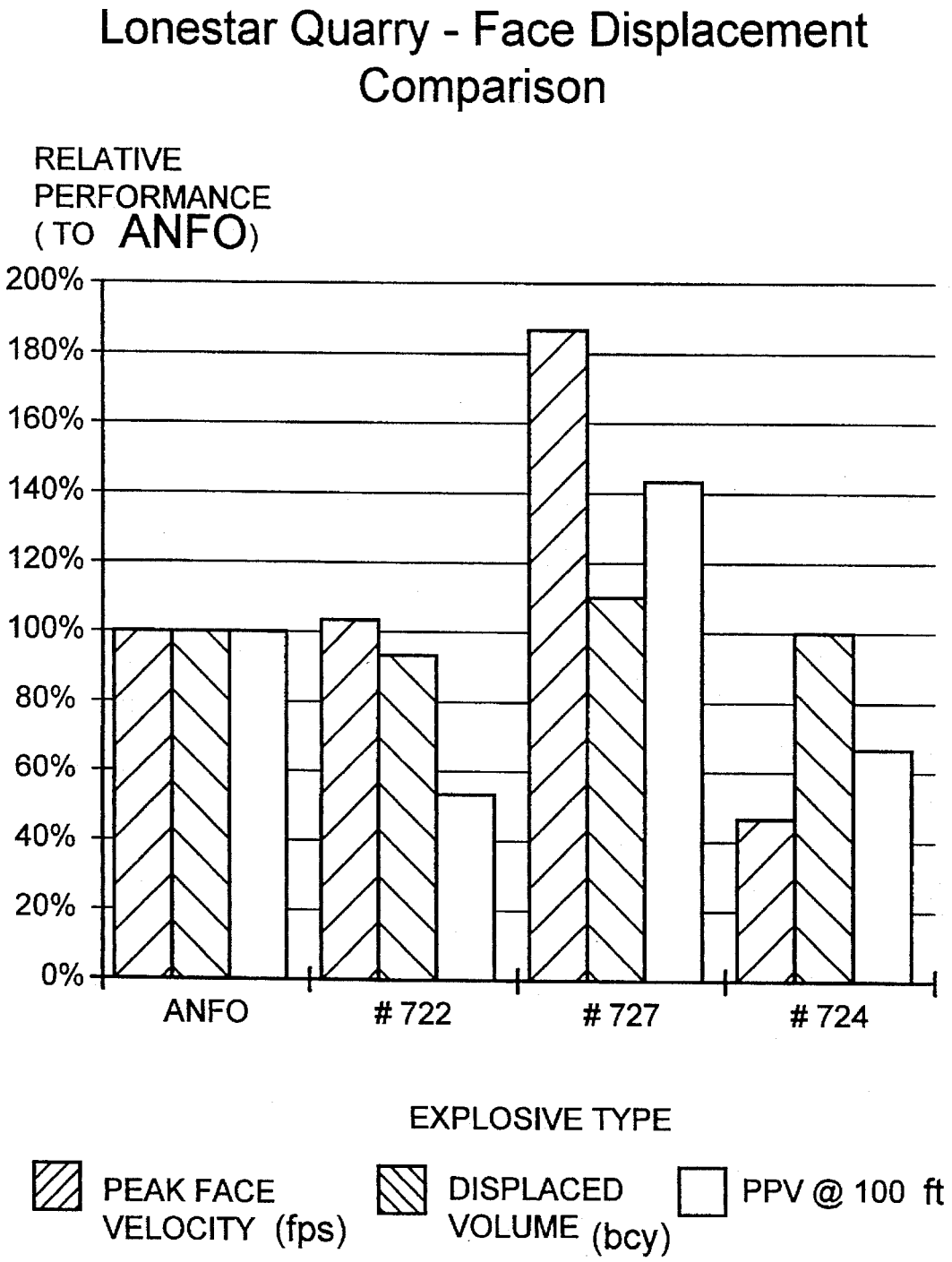

FIG. 6 shows a comparison of the displacements of the various inventive compositions with the ANFO standard. As shown in FIG. 6, the displaced volume for each of the inventive compositions was substantially the same or somewhat better than that for ANFO alone.

We claim:

1. A composition for quarry blasting comprising from about 13 to 15 weight percent of wax, from about 15 to 25 weight percent of aluminum powder, from about 10 to 52 weight percent sodium perchlorate and from about 10 to 52 weight percent ammonium nitrate, all weights being based on the total weight of the composition.

2. The composition of claim 1 wherein the amount of wax is 15 weight percent, the amount of aluminum powder is 25 weight percent, the amount of sodium perchlorate is 10 weight percent and the amount of ammonium nitrate is 50 weight percent.

3. The composition of claim 1 wherein the amount of wax is 15 weight percent, the amount of aluminum powder is 15 weight percent, the amount of sodium perchlorate is 10 weight percent and the amount of ammonium nitrate is 60 weight percent.

4. The composition of claim 1 wherein the amount of wax is 13 weight percent, the amount of aluminum powder is 25 weight percent, the amount of sodium perchlorate is 10 weight percent and the amount of ammonium nitrate is 52 weight percent.

5. The composition of claim 1 wherein the amount of wax is 13 weight percent, the amount of aluminum powder is 25 weight percent, the amount of sodium perchlorate is 52 weight percent and the amount of ammonium nitrate is 10 weight percent.

6. A blasting system comprising a mixture of two components, the first component being ANFO, and the second component being a composition comprising from about 13 to 15 weight percent of wax, from about 15 to 25 weight percent of aluminum powder, from about 10 to 52 weight percent sodium perchlorate and from about 10 to 52 weight percent ammonium nitrate, all weights being based on the total weight of the composition, wherein the weight ratio of the first component to the second component is from about 70/30 to 30/70.

7. The system of claim 6 wherein the weight ratio of the first component to the second component is from about 40±2:60±2 to 60±2 to 40±2.

* * * * *